United States Patent [19]

Haemers

[11] 4,255,496

[45] Mar. 10, 1981

[54] STEEL WIRE REINFORCING ELEMENTS WITH A BRASS-COBALT ALLOY ADHESIVE COATING

[75] Inventor: Guy Haemers, Deerlijk, Belgium

[73] Assignee: N. V. Bekaert S.A., Zwevegem, Belgium

[21] Appl. No.: 40,902

[22] Filed: May 21, 1979

[30] Foreign Application Priority Data

May 26, 1978 [GB] United Kingdom ..... 23062/78

[51] Int. Cl.[3] ..... B32B 15/00

[52] U.S. Cl. ..... 428/677; 152/359; 156/110 A; 156/124; 428/465; 428/625; 428/676; 428/466

[58] Field of Search ..... 428/625, 676, 677, 465, 428/466; 152/359; 156/110 A, 124

[56] References Cited

U.S. PATENT DOCUMENTS

| | | | |
|---|---|---|---|
| 2,240,805 | 5/1941 | Semon | 428/625 X |
| 2,296,838 | 9/1942 | Domm | 428/625 |
| 2,643,273 | 6/1953 | Wilkins | 428/469 X |
| 2,870,526 | 1/1959 | Adler | 428/658 |
| 2,939,207 | 6/1960 | Adler | 428/625 |
| 3,311,458 | 3/1967 | Schunemann | 428/676 X |
| 3,517,722 | 6/1970 | Endter et al. | 152/359 |
| 3,749,558 | 7/1973 | Dillenschneider | 428/677 X |
| 3,858,635 | 1/1975 | Nakamoto et al. | 152/359 X |

FOREIGN PATENT DOCUMENTS

| | | | |
|---|---|---|---|
| 2077770 | 5/1971 | France | 428/625 |

*Primary Examiner*—L. Dewayne Rutledge
*Assistant Examiner*—W. G. Saba
*Attorney, Agent, or Firm*—Edward J. Brenner

[57] ABSTRACT

A steel wire element useful in the reinforcement of rubber compositions in which the steel wire is provided with an adhesive coating comprising a brass alloy containing 58% to 75% copper, and cobalt in an amount sufficient in use to improve the adhesion between the coated steel wire and the rubber composition. Preferably the brass alloy contains 2% to 4% of cobalt. Applications include coated steel cords for use in vehicle tires and conveyor belts and hoses.

8 Claims, No Drawings

STEEL WIRE REINFORCING ELEMENTS WITH A BRASS-COBALT ALLOY ADHESIVE COATING

The present invention relates to steel wire elements for use in the reinforcement of rubber compositions of the type hereinafter described.

It is frequently necessary to reinforce rubber compositions, for example, for use in tires, conveyor or timing belts, hoses and like products, by incorporating therein steel wire reinforcing elements.

The steel wire forming such elements may be for example in the form of a single strand or a steel wire cord. The steel wire generally has a tensile strength of at least 2000 Newton per square millimeter, and an elongation at rupture of at least 1%, preferably at least 2.5%. The wire conveniently has a circular cross-section obtained for example by wire drawing, but wire prepared by other processes as well as wire of other cross-sectional shapes may be employed such as for example steel wires obtained by rolling, or steel wires of limited length and rectangular cross-sectional shape, e.g. as obtained by cutting steel strip. Non-circular cross-section wires have in general a diameter, which is equivalent to the diameter of a circular cross-section wire of the same surface area, which diameter ranges from 0.05 to 0.40 mm.

Such steel wire reinforcing elements are in general provided with a coating serving to provide adhesion to the rubber composition which it is to reinforce. This coating element which contacts the rubber composition or, more frequently to the external surface of each individual reinforcing wire in the element. The above-mentioned coating may for example comprise a layer of brass alloy which is often used for the purpose mentioned above.

In steel wire-reinforced rubber articles, such as tires, conveyor and timing belts, hoses and other similar products, that part of the rubber composition which contacts the steel wire reinforcing elements is of a special type, although the remainder may be of a different composition to meet other requirements. These rubber compositions which contact the steel wire elements are well-known in practice, their ingredients and the proportions thereof being subject to variation for example according to their desired application. However, such compositions comprise in general a considerable amount of carbon black, most frequently in the range of 40 to 70% parts by weight per 100 parts of rubber, further amounts of filler(s) such as coumarone resin, and of zinc oxide, small amounts of sulphur and accelerator agents, and further optional incidental ingredients (such as anti-oxidants) present in small amounts. Such rubber compositions are hereinafter identified as "rubber compositions of the type referred to".

In general, the layer of brass alloy mentioned above has a thickness of from 0.05μ to 0.40μ, preferably from 0.12μ to 0.22μ, and contains 58 to 75%, preferably about 70% of copper, the balance being zinc and any incidental impurities present in small amounts, the percentages being calculated on an atomic basis, i.e. the relative quantity of atoms with respect to the total quantity. Such coatings are currently on the market.

The adhesion between the rubber compositions of the type referred to and the steel wire reinforcing element may for example be regarded as sufficient when on average for the particular rubber composition in question, the resistance to shearing at the rubber/steel interface is at least 5 Newtons per square millimeter of interface. For steel cord in particular, however, this adherence is measured by the standard adhesion test as described below, and adhesion is expressed as a minimum average result at 5 Newton pulling force per square millimeter of interface.

When such brass alloys coated steel reinforcements are present in the rubber composition during vulcanization, the bond between the rubber and steel wire gradually builds up to a maximum due to chemical reaction of the brass alloy with the rubber at the interface forming a bonding interface layer. The bond then breaks down again by degradation of this layer, probably by secondary reactions which decompose the layer. After vulcanization and during the further lifetime of the reinforced composition, these reactions continue at much lower speed by heat ageing, e.g. in a running tires, and this, togethr with oxidative degradation of the rubber itself, contributes to the further destruction of the bond. The speed of the adhesion reaction must be well adapted to the duration of vulcanization, and for this reason, the content of copper, which is known to be an accelerator for the adhesion reaction, must not be too high. Zinc may therefore be added to the copper in order to decelerate the reaction.

It has been observed that humidity is in general very detrimental for the adhesion between the brass alloy-coated steel reinforcements and the rubber compositions, not only during the lifetime of the rubber composition, but also during vulcanization in humid conditions, where the green rubber stock may absorb 0.5 to 1% of water. To minimize such loss of adhesion brass alloy-coated steel wires may be dipped in a solution of mineral oil before vulcanization as described in German Pat. No. 2,227,013 for steel cord in vehicle tires. This solution requires the manufacturer of the reinforced rubber composition to carry out an additional operation before vulcanization, and it is the aim of the supplier of the reinforcing elements to deliver to the manufacturers of the reinforced rubber compositions, elements e.g. in the form of wire or cord, for which such preliminary treatment is not required.

Another solution to the above-mentioned humidity problem involves the use of a lower copper content in the brass alloys. Whereas the most usual copper content in such alloys is in the range of 70 to 75%, it has been proposed to use copper contents of below 70%, even below 60%, as described in British Pat. No. 1,250,419. However, the brass alloy thereby obtained consists mainly of β-brass, in contrast to the α-brass obtained with the conventional amount of 70–75% of copper. Such β-brass alloys are difficult to work. This is a serious handicap when using low copper brass, because the brass alloy on the steel wire serves as a lubricant during further work-hardening of the steel, e.g. when the brass alloy-coated steel is in the form of thick wire which is to be reduced in diameter by further drawing steps before being twisted into steel cord. During these work-hardening steps, the brass is also work-hardened, whilst simultaneously acting as drawing lubricant. The transition from 100% α-brass at 70% Cu to 100% β-brass at 50% Cu is gradual, and it is for that reason that the copper content in practice has only been lowered to the range of 62–67%, thereby losing to some extent, the workability of the coating, but solving, to some extent the humidity problem, a compromise thus being effected between these conflicting factors.

It is an object of the present invention to provide new and improved brass alloy-coated steel wire elements for use in the reinforcement of rubber compositions of the type referred to. According to one feature of the present invention we provide steel wire elements for use in the reinforcement of rubber compositions of the type referred to wherein the steel wire is provided with an adhesive coating comprising a brass alloy containing 58 to 75% of copper, and cobalt in an amount sufficient in use to provide adhesion between the coated steel wire and a rubber composition of the type referred to applied thereto.

In practice, the brass alloy preferably contains 0.5% to 10%, advantageously 1 to 7%, and most preferably 2% to 4%, of cobalt since high proportions of cobalt tend to reduce the workability of the brass alloy.

According to a further feature of the present invention we provide rubber compositions containing as reinforcing means at least one steel wire element according to the invention as hereinbefore defined.

The rubber compositions may, for example, be in the form of vehicle tires.

From experiments which we have carried out we have found that the steel wire reinforcing elements according to the present invention can provide improved adhesion to rubber compositions of the type referred to. Moreover, we have found that the brass alloy coating can provide satisfactory adhesion even under humid conditions, thereby avoiding the need to use a copper content below the range of 67% to 75% wherein the brass alloy is capable of being satisfactorily work-hardened.

The term "brass alloy" is used herein to denote an alloy wherein the principal constituents are copper and zinc, copper being present in the amount specified above. Brass alloys which may be employed include not only binary alloys, but also ternary alloys, such alloys containing additional incidental ingredients such as nickel and tin present in minor amounts. The coating may, in addition to the brass alloy layer, comprise other layers. When the brass alloy layer is obtained by heat diffusion of separate layers of the individual constituents, the composition varies across the thickness of the layer. Hence, the composition percentages are average percentages over the thickness of the layer.

Preferably, when the brass alloy is work hardened, the copper content will be in a range between 67 and 75%. Although cobalt has the effect of promoting the formation of the difficultly workable $\beta$-structure, it has been found that its presence sufficiently improves adhesion in all conditions to allow the use of copper contents in a higher range, i.e. in the optimum workable range of 67 to 75%, and this higher copper content militates against the formation of $\beta$-brass, to a greater extent than that to which formation of $\beta$-brass is promoted by the addition of cobalt.

For a better understanding of the invention, the following examples are given by way of illustration only. In these examples the steel wire element was formed from steel cord, obtained by drawing wire rods to an intermediate diameter of 1.14 millimeters, patenting, acid pickling, rinsing and passing the wire through a system for applying the brass alloy layer, and further drawing the wire in a soap-solution down to a final diameter of 0.25 millimeter. Five such wires were twisted into a steel cord with a pitch of 1 turn per 10 millimeters.

Different types of such cord were made:

type Cu-Zn: For comparative purposes this is a normal production cord having as adhesive coating a brass alloy layer of 0.25$\mu$ thickness with the composition: 67.5% copper, 32.5% zinc.

type LCu-Zn: Also for comparative purposes: this is a low copper production cord type for use in humid conditions, having as an adhesive coating a brass alloy layer of 0.25$\mu$ thickness with the composition: 63.5% copper, 36.5: zinc.

type CU-Co-Zn: is a cord according to the invention, having as adhesive coating a brass layer of 0.25$\mu$ thickness with composition : 71.9% copper, 3.9% cobalt, 24.2% zinc. For applying the brass alloy layer the following steps were carried out: firstly electroplating a copper layer of 7.27 g. per square meter in a solution of copper pyrophosphate including about 27 g. per liter of copper ion, the proportion by weight of $P_2O_7$-ions with respect to the copper-ions being kept in the range between 6.5 to 8 by addition of $K_4(P_2O_7)$, the pH being held in the range from 8 to 8.5, the bath temperature at 50° C., the current density at about 10 amps per square decimeter; after rinsing, electroplating a cobalt layer of 0.43 g. per square meter in a solution of cobalt sulphate including about 17 g. per liter of cobalt ion, and adding 65 g. per liter of ammonium sulphate, the pH being kept at 7, the temperature at about 25° C., the current density about 2 amps per square decimeter; after rinsing, electroplating a zinc layer of 3.15 g. per square meter in a solution of zinc sulphate including about 70 g. per liter of zinc ion, the pH being kept at 2.5, the bath at room temperature, the current density at 30 amps per square decimeter; then continuously passing the coated wire to a heat diffusion furnace, where each surface part is exposed for a time of at least 8 seconds to a temperature of 450° C. under a protective atmosphere, so as to form a ternary brass alloy with cobalt as a tertiary element; finally drawing the thus coated wire in 15 passes in a soap solution, and taking into account the losses of brass lubricant in the drawing process, finally obtaining a coating having the thickness and composition above.

Such cords are then tested in rubber compositions A to D, as defined in Table I below:

TABLE I

| | A | B | C | D |
|---|---|---|---|---|
| Natural rubber | 100 | 100 | 100 | 100 |
| Carbon black | 60 | 50 | 50 | 60 |
| Coumarone resin | 4 | 4 | 4 | 4 |
| Zinc oxide | 5 | 10 | 10 | 8 |
| Stearic acid | 1 | 2 | 1 | 1 |
| Sulphur (Crystex) | 4 | 2 | 4 | 4.5 |
| Antioxidant phenyl-$\beta$-naphtylamine (known as A.O. PBN) | 1 | — | — | — |
| Antioxidant N-1,3 dimethylbutyl-N'-phenyl-p-phenylenediamine (A.O. Santoflex 13) | — | — | 1.5 | 1.5 |

TABLE I-continued

| | A | B | C | D |
|---|---|---|---|---|
| Accelerator cyclohexylbenzothiazolesulphenamide (Vulcacit CZ) | 0.8 | — | — | — |
| Accelerator dicyclohexylbenzothiazolesulphenamide (Vulcacit DZ) | — | — | 0.7 | 0.7 |
| Accelerator mercapto-benzo-thiazole | — | 0.5 | — | — |
| $NiCl_2 . 6H_2O$ | — | — | 4 | — |

The cords are vulcanized in a piece of rubber according to A.S.T.M.-Standard D2229-73, with a length of 12.5 mm embedded, the temperature and duration of vulcanization being adapted to reach 90% of the maximum torsion momentum on the rheometer-curve for that rubber. (Temperature: 150° C., $T_c90$, for the rubber compositions A to D being respectively 22½, 15, 17 and 21 minutes).

For each type of rubber different treatments of the rubber sample are provided for simulation of different test conditions. The treatments are indicated by a figure as follows:

1: Non-aged: sample as prepared above

2: Wet rubber: vulcanization as above, but green rubber stock including 1% of water, for simulating vulcanization in humid atmosphere.

3: Overcure: sample as prepared above, but vulcanization time three times longer than in case 1.

4: Steam ageing: sample 1, treated during 8 hours in a closed steam atmosphere at 120° C.

5: Heat ageing: sample 1, treated during one week in a drying furnance at 120° C.

6: Salt spray 4: sample 1 during 4 days in a 98% relative humidity of water solution of 5% NaCl at 35° C.

7: Salt spray 8: same treatment as 6, but for 8 days.

8: Salt spray 12: same treatment as 6, but for 12 days.

The steel cord in the thus prepared samples are submitted to a pull-out test according to A.S.T.M.-standard D 2229-73. The results are given below in Table II, for the rubber compositions A to D, and each for the three cord types, Cu-Zn, LCuZn and Cu-Co-Zn respectively, and for each combination of rubber and cord, the results for the test conditions 1 to 8 above are expressed in terms of the average necessary pull-out force ($\bar{x}$), in Newtons, samples, and of the standard deviation $$\sigma = \frac{\sqrt{\Sigma(x_i - \bar{x})}}{}$$

for these ten samples.

TABLE II

| | | A | | B | | C | | D | | |
|---|---|---|---|---|---|---|---|---|---|---|
| | | $\bar{x}$ | $\sigma$ | $\bar{x}$ | $\sigma$ | $\bar{x}$ | $\sigma$ | $\bar{x}$ | $\sigma$ | Σ A-D |
| Cu-Zn | 1 | 250 | 13 | 184 | 9 | 425 | 60 | 255 | 24 | |
| | 2 | 394 | 57 | 210 | 16 | 396 | 12 | 352 | 62 | |
| | 3 | 265 | 15 | 206 | 9 | 358 | 34 | 275 | 10 | |
| | 4 | 424 | 14 | 327 | 39 | 346 | 49 | 366 | 39 | |
| | 5 | 197 | 19 | 173 | 12 | 350 | 49 | 259 | 26 | |
| | 6 | 253 | 40 | 195 | 38 | 453 | 26 | 276 | 17 | |
| | 7 | 255 | 19 | 204 | 18 | 445 | 44 | 326 | 37 | |
| | 8 | 232 | 20 | 169 | 26 | 439 | 22 | 281 | 22 | |
| | $\frac{\Sigma 1-8}{8}$ | 284 | | 208 | | 401 | | 299 | | 298 |
| Cu-Zn | 1 | | | 184 | 9 | 475 | 17 | 273 | 27 | |
| | 2 | | | 281 | 20 | 418 | 36 | 249 | 28 | |
| | 3 | | | 192 | 8 | 385 | 12 | 274 | 16 | |
| | 4 | | | 357 | 26 | 425 | 63 | 387 | 34 | |
| | 5 | | | 153 | 12 | 328 | 34 | 238 | 14 | |
| | 6 | | | 183 | 26 | 448 | 32 | 287 | 23 | |
| | 7 | | | 187 | 12 | 478 | 41 | 319 | 27 | |
| | 8 | | | 139 | 26 | 461 | 37 | 265 | 15 | |
| | $\frac{\Sigma 1-8}{8}$ | | | 209 | | 427 | | 286 | | 307 |
| Cu-Co-Zn | 1 | 437 | 19 | 277 | 14 | 479 | 24 | 343 | 24 | |
| | 2 | 451 | 62 | 315 | 21 | 451 | 32 | 404 | 30 | |
| | 3 | 443 | 24 | 315 | 24 | 404 | 33 | 393 | 31 | |
| | 4 | 547 | 30 | 504 | 66 | 366 | 11 | 482 | 45 | |
| | 5 | 317 | 26 | 214 | 7 | 380 | 40 | 350 | 44 | |
| | 6 | 383 | 55 | 240 | 27 | 471 | 32 | 324 | 34 | |
| | 7 | 407 | 21 | 235 | 29 | 483 | 14 | 392 | 28 | |
| | 8 | 352 | 51 | 193 | 27 | 449 | 23 | 318 | 49 | |
| | $\frac{\Sigma 1-8}{8}$ | 417 | | 286 | | 435 | | 375 | | 378 |

It can be observed that the adhesion, on an average for the four sorts of rubbers tested, was about 25% higher with the Cu-Co-Zn-cord than with the Cu-Zn-cords, i.e. with a cord where the wires were easier to draw because of the higher copper content in the brass.

What is claimed is:

1. A steel wire element for use in the reinforcement of rubber compositions wherein the steel wire is provided with an adhesive coating comprising a brass alloy containing about 58% to 75% of copper and about 0.5 to 10% of cobalt to improve the adhesion between the coated steel wire and said rubber composition.

2. A steel wire element as claimed in claim 1 wherein said brass alloy contains about 1% to 7% of cobalt.

3. A steel wire element as claimed in claim 2 wherein said brass alloy contains about 2% to 4% of cobalt.

4. A steel wire element as claimed in claim 1 wherein the said brass alloy contains about 67% to 75% of copper.

5. A steel wire element as claimed in claim 4 wherein the steel wire provided with said adhesive coating has been subjected to work hardening.

6. A steel wire element as claimed in claim 1 in the form of steel cord.

7. A steel wire element as claimed in claim 1 wherein said adhesive coating has a thickness of 0.05 to 0.40μ.

8. A steel wire element as claimed in claim 7 wherein said adhesive coating has a thickness of 0.12 to 0.22μ.

* * * * *